US005794281A

United States Patent [19]

Shearon

[11] Patent Number: 5,794,281

[45] Date of Patent: Aug. 18, 1998

[54] SHOWER CURTAIN APPARATUS AND METHOD

[75] Inventor: James C. Shearon, Englewood, Colo.

[73] Assignee: Unifran Inc., Highlands Ranch, Colo.

[21] Appl. No.: 788,763

[22] Filed: Jan. 24, 1997

[51] Int. Cl.[6] ..... A47K 3/14

[52] U.S. Cl. ..... 4/558; 4/608; 4/610; 160/29; 160/336

[58] Field of Search ..... 4/558, 608, 609, 4/610, 600, 533, 534; 160/23.1, 24, 29, 31, 335, 336, DIG. 6

[56] References Cited

U.S. PATENT DOCUMENTS

| | | | |
|---|---|---|---|
| 1,443,753 | 1/1923 | McClure | 4/558 X |
| 2,011,662 | 8/1935 | Thompson | 4/558 |
| 2,313,421 | 3/1943 | Dalton, Jr. | 4/558 |
| 2,465,853 | 3/1949 | Dalton, Jr. | 4/558 |
| 2,481,397 | 7/1949 | Dalton, Jr. | 4/558 |
| 2,498,563 | 2/1950 | Mallory | 160/24 |
| 2,756,438 | 7/1956 | Soberman | 4/608 |
| 2,840,827 | 7/1958 | Calvano | 4/558 |
| 2,855,041 | 10/1958 | Blashfield et al. | 160/336 |
| 3,222,689 | 12/1965 | Efron et al. | 4/608 |
| 3,386,106 | 6/1968 | Clemens | 4/608 |
| 3,582,998 | 6/1971 | Morse | 4/608 |
| 3,965,960 | 6/1976 | Massey | 160/295 |
| 4,122,559 | 10/1978 | Kellly | 4/608 |
| 4,220,189 | 9/1980 | Marquez | 160/23.1 |
| 4,333,187 | 6/1982 | Schuler | 4/608 |
| 4,398,585 | 8/1983 | Marlow | 160/23.1 |
| 4,777,673 | 10/1988 | Patteson et al. | 4/558 |
| 4,916,764 | 4/1990 | Meaden et al. | 4/558 |
| 5,033,132 | 7/1991 | Greenblatt | 4/608 |
| 5,351,739 | 10/1994 | Levy | 160/124 |

*Primary Examiner*—Robert M. Fetsuga
*Attorney, Agent, or Firm*—Sheridan Ross P.C.

[57] ABSTRACT

A shower curtain assembly having a vertically moveable flexible water barrier is disclosed wherein the water barrier is extendable from and retractable into a support assembly traversing an upper portion of a shower enclosure opening. Additionally, the support assembly is pivotally retractable to a vertical position adjacent a wall of the shower enclosure. Thus, in the retracted configuration, the shower enclosure opening is left unencumbered by the support assembly and the water barrier, and in an extended configuration wherein the support assembly is supported across the upper portion of the shower enclosure opening, the flexible water barrier can be extended downward to form a barrier to water escaping from the shower enclosure.

7 Claims, 9 Drawing Sheets

SHOWER CURTAIN APPARATUS AND METHOD

FIELD OF THE INVENTION

The present invention relates to a shower curtain apparatus for a shower enclosure entry, wherein in one configuration the shower curtain apparatus has a supporting assembly with a vertically movable shower curtain attached thereto, and in a second configuration, the shower curtain and its supporting assembly are folded vertically into a wall connector assembly against the wall of the shower enclosure.

BACKGROUND OF THE INVENTION

Shower curtains as typically used for retaining water in a shower enclosure are normally draped from a shower bar extending across the opening of the shower enclosure. Such shower bars and the draped shower curtain are considered aesthetically unappealing or undesirable by many people.

In particular, such a shower curtain can be undesirable in that the shower curtain can easily become soiled or stained by constant contact with a shower base or tub enclosure. Moreover, it is somewhat difficult to clean such a shower curtain when in place. Thus, for cleaning, removal and replacement of the shower curtain from the shower curtain bar is likely to be required. However, since this is an awkward task, it becomes difficult to maintain the shower curtain in a clean state. Further, undue effort must be expended if the shower curtain is to be positioned, for example, at the side of the shower enclosure, wherein the shower curtain is rolled up neatly on the shower curtain bar without substantial wrinkles. Accordingly, it would be desirable to have a shower curtain that, when not in use, is retracted by pivoting into a compact wall connector assembly compartment. Further, it would also be advantageous if the shower curtain bar (or any other equivalent cross member for the shower enclosure entry) could also be pivoted down into the compact wall connector assembly compartment, thereby removing both the shower bar and its attached shower curtain from view. Finally, it would also be advantageous to have the shower curtain easily removable from the shower bar (or equivalent cross member support) so that it is straightforward to replace soiled shower curtains with a clean shower curtain.

SUMMARY OF THE INVENTION

The present invention is a novel shower curtain assembly wherein both an included upper support assembly from which a shower curtain hangs (over a shower enclosure entry), and the shower curtain itself can be retracted from view. In particular, when the upper support assembly is positioned across the shower enclosure, the shower curtain (more generally, flexible water barrier) is downwardly extendable from and upwardly retractable into the upper support assembly, and when the shower curtain is fully retracted into this assembly, the upper support assembly can also be disengaged from its horizontal position across the shower enclosure entry and pivotally rotated to a vertical position into the wall connector assembly adjacent a wall of the shower enclosure. Thus, the shower curtain assembly of the present invention can be compactly folded away when not in use, and additionally easily extended across the shower enclosure entry immediately prior to use.

In order to provide support for the upper support assembly in both the retracted vertical compact configuration and on one side of the extended horizontal configuration across the shower enclosure entry, it is an aspect of the present invention to provide an elongated wall connector assembly whose length is vertically mounted on the wall of the shower enclosure such that its uppermost vertical end is pivotally attached to the upper support assembly. Thus, in addition to the upper support assembly being supported by the wall connector assembly, the upper support assembly pivots into alignment with the wall connector assembly when in the retracted configuration, and pivots in an opposite direction for extension across the shower enclosure entry in the extended configuration. Additionally, it is an aspect of the present invention that the wall connector assembly have spaced apart legs projecting outwardly from the shower enclosure wall to which the assembly is attached, thereby providing a slot or track in which the shower curtain (or flexible water barrier) and a corresponding curtain rod, attached near a free end of the flexible water barrier, can vertically between the legs and thereby be maintained in a position that inhibits the flow of water outside the shower enclosure.

It is an additional aspect of the present invention that on the opposite shower enclosure wall to the wall having the wall connector assembly, there is a receiver member into which the distal or free end of the upper support assembly is supported when the upper support assembly is in its extended configuration across the shower enclosure entry. It is a further aspect of this receiver member that it includes pivotal portions or wings that can be extended to support the upper support assembly across the shower enclosure entry, or when not providing this support, the wings may be folded inwardly and adjacent the shower enclosure wall to which the receiver member is attached.

It is an additional aspect of the present invention that the vertically movable flexible water barrier is attached to a cylindrical barrel within the upper support assembly so that this water barrier can be moved substantially like a vertical window shade that is retractable and extendable about its window shade barrel.

It is also an aspect of the present invention that the flexible water barrier include a lower section having the above-mentioned weighted shower curtain rod across its horizontal free end for maintaining the water barrier in a desired position when fully extended from the upper support assembly. Additionally, the lower section of the water barrier includes a layer of material that can be considered as a removable shower curtain. That is, this layer of material extends over the lower section of the water barrier for inhibiting the exit of water from the shower enclosure entry. In one embodiment, the removable shower curtain layer is incorporated as part of the flexible water barrier by Velcro so that the removable shower curtain layer can be easily replaced when soiled. Additionally, when the flexible water barrier is fully extended, above the lower section of the water barrier is an upper section having a mesh consistency that allows for the substantially free flow of air and steam but inhibits larger droplets from shower spray to pass therethrough.

Additional benefits and aspects of the present invention are provided in the detailed description and the figures hereinbelow.

DETAILED DESCRIPTION OF THE PREFERRED EMBODIMENT

Figure 1:
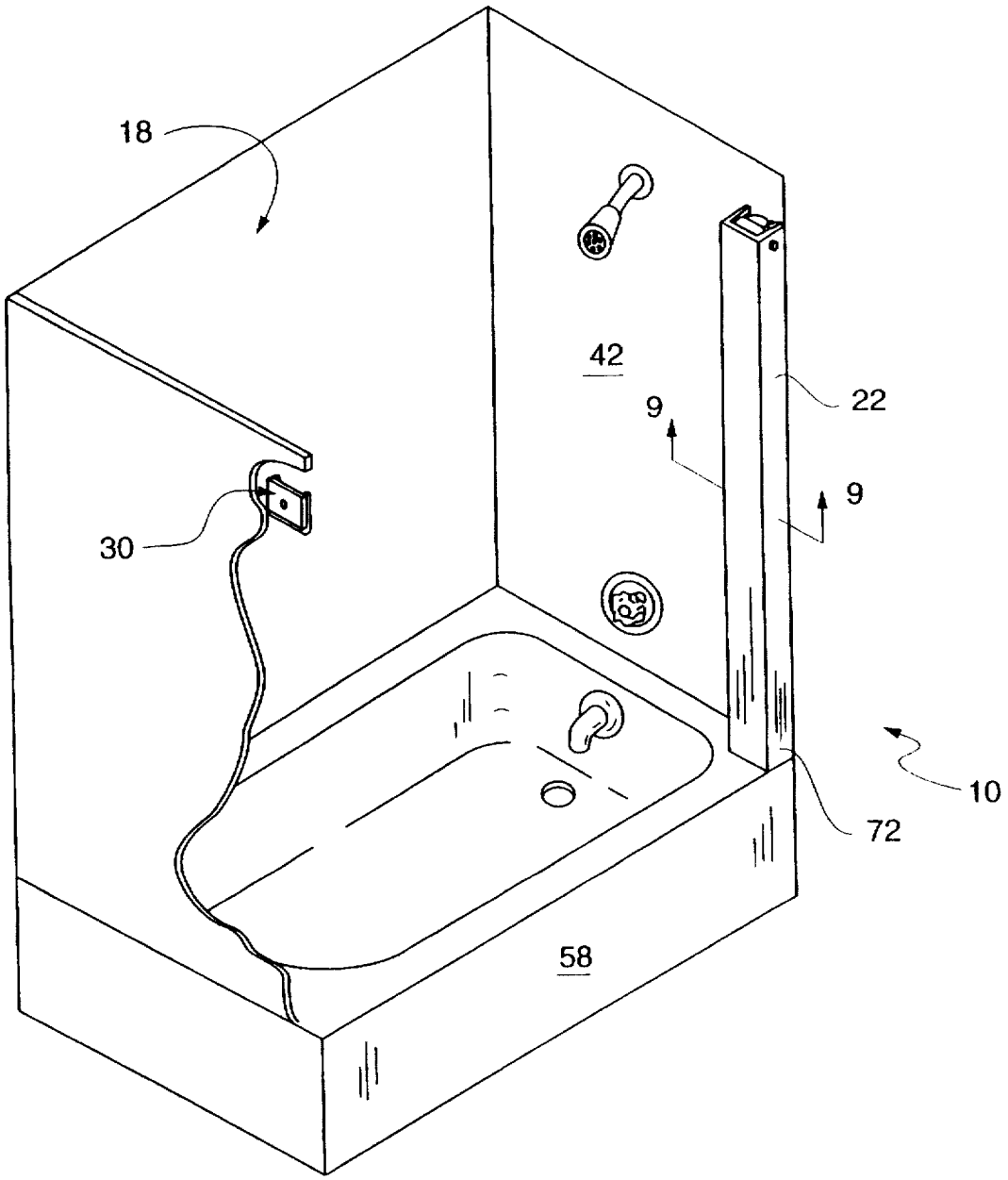
FIG. 1 is a perspective view of the present invention in a retracted configuration as, for example, when it is not in use as a shower curtain.
Figure 2:
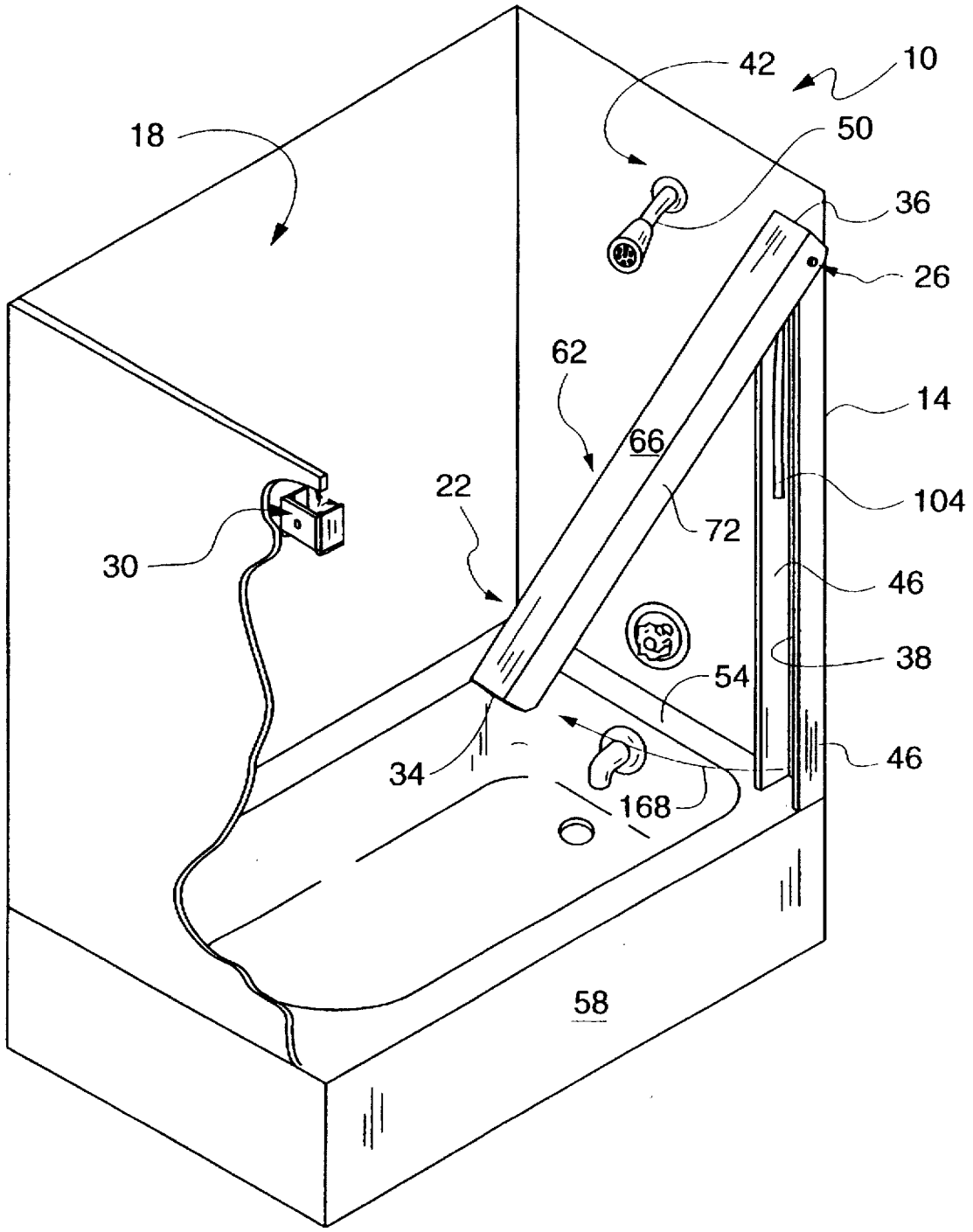
FIG. 2 is a perspective view of the upper support assembly 22 pivoted half-way from the wall connector assembly 14.

FIGS. 1 through 6 illustrate various operating positions of the shower curtain assembly 10 of the present invention. Referring first to FIG. 2, shower curtain assembly 10 includes three components or subassemblies at the highest level. In particular, a wall connector assembly 14 is vertically attached to a shower enclosure wall 42 adjacent to or in an entry way into, for example, the shower enclosure 18. Pivotally connected to the uppermost vertical end of the wall connector assembly 14 is an upper support assembly 22 that pivots (on pivot 26) from a first retracted position substantially coincident with the wall assembly 14 (e.g. FIG. 1) to an extended position traversing the opening to the shower enclosure 18 (e.g. FIG. 3). Additionally, the shower curtain assembly 10 includes a receiver member 30 for receiving the free end 34 of the upper support assembly 22 and thereby supporting this assembly across the shower enclosure opening.

Figure 7:
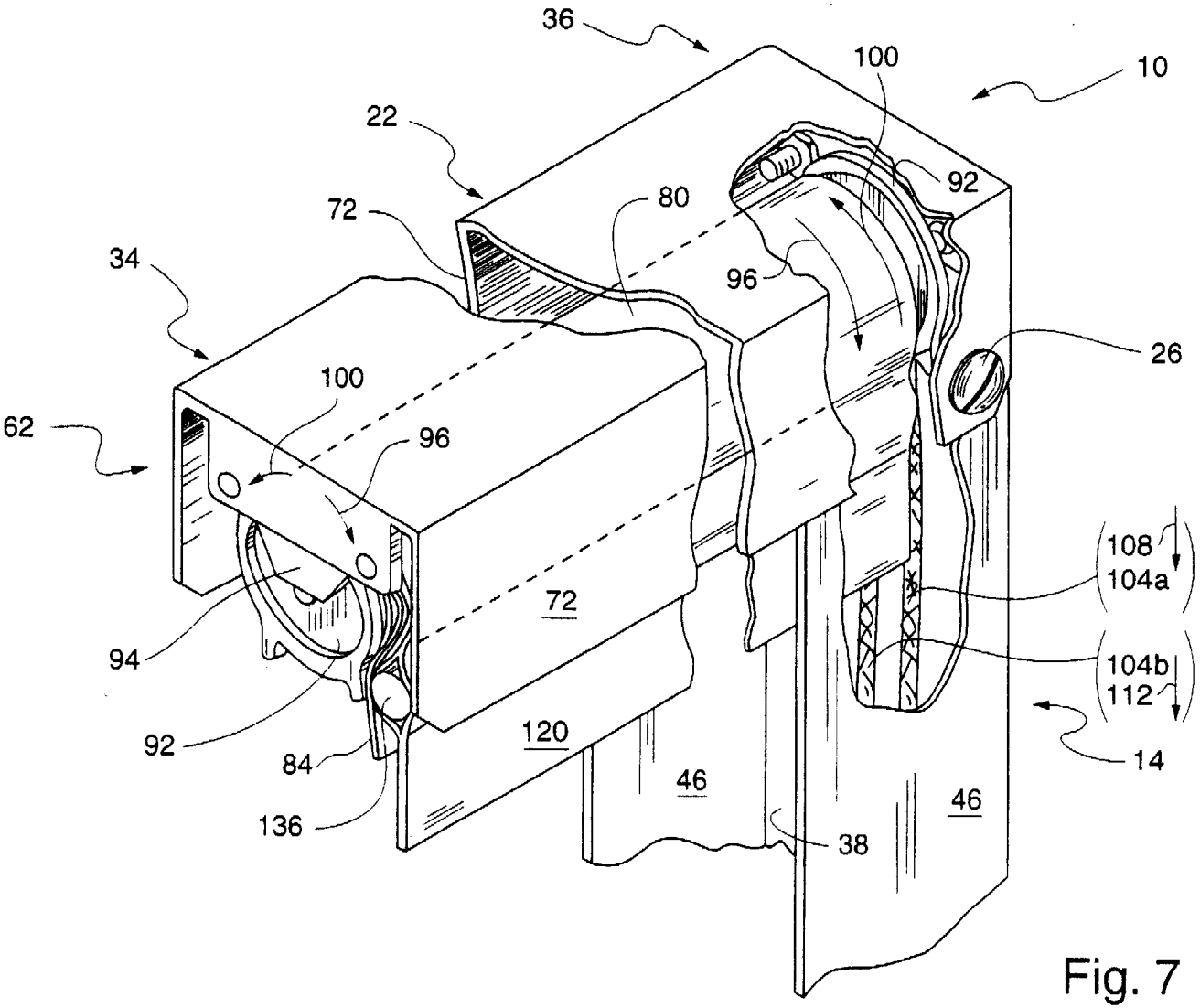
FIG. 7 is an enlarged perspective view of the present invention wherein the upper support assembly 22 is pivoted away from the wall connector assembly 14.

Regarding the wall connector assembly 14 (as shown in, e.g., FIGS. 2 and 7), it includes a back plate 38 substantially parallel with and affixed to, for example, a shower enclosure wall 42. Additionally, the wall connector assembly 14 includes spaced apart legs 46 that project away from the shower enclosure wall 42 and into the shower enclosure opening. Note that the legs 46 and the back plate 38 may be formed from a single metal piece, or alternatively, may be composed of molded plastic. However, regardless of the composition, the legs 46 and the back plate 38 are connected together for forming an effective support and reinforcement for the upper support assembly 22 when in its retracted configuration. Additionally, since the back plate 38 is affixed to the shower enclosure wall 42 by, for example, double faced tape and/or screws, and since the legs 46 project into the shower enclosure opening, the legs and back plate assist in maintaining water in the shower enclosure 18. That is, water exiting the shower head 50 and collecting on the wall 42 and/or pooling on the ledge 54 can be directed by the legs 46 to stay in the shower enclosure 18. Thus, the lower end of the wall connector assembly 14 may sealingly contact the shower enclosure base 58. Moreover, it is preferable that the legs have a width projecting into the shower opening from the shower enclosure wall 42 of approximately ½ inch to 3 inches and more preferably approximately 2 inches.

Figure 3:
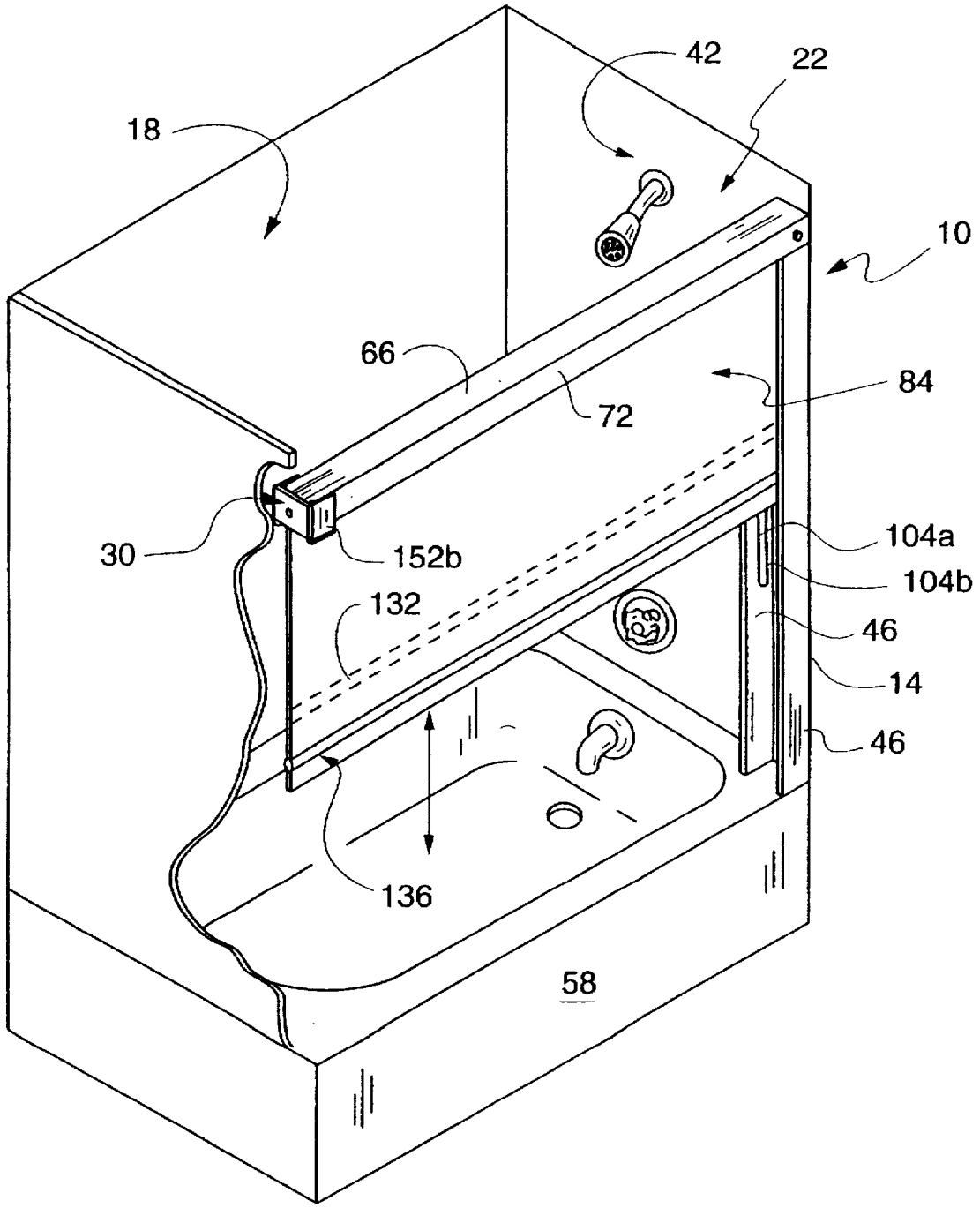
FIG. 3 is a perspective view of the upper support assembly 22 fully pivoted and held by its free end 34 in the receiving member 30 and with the flexible water barrier 84 halfway down.
Figure 9:
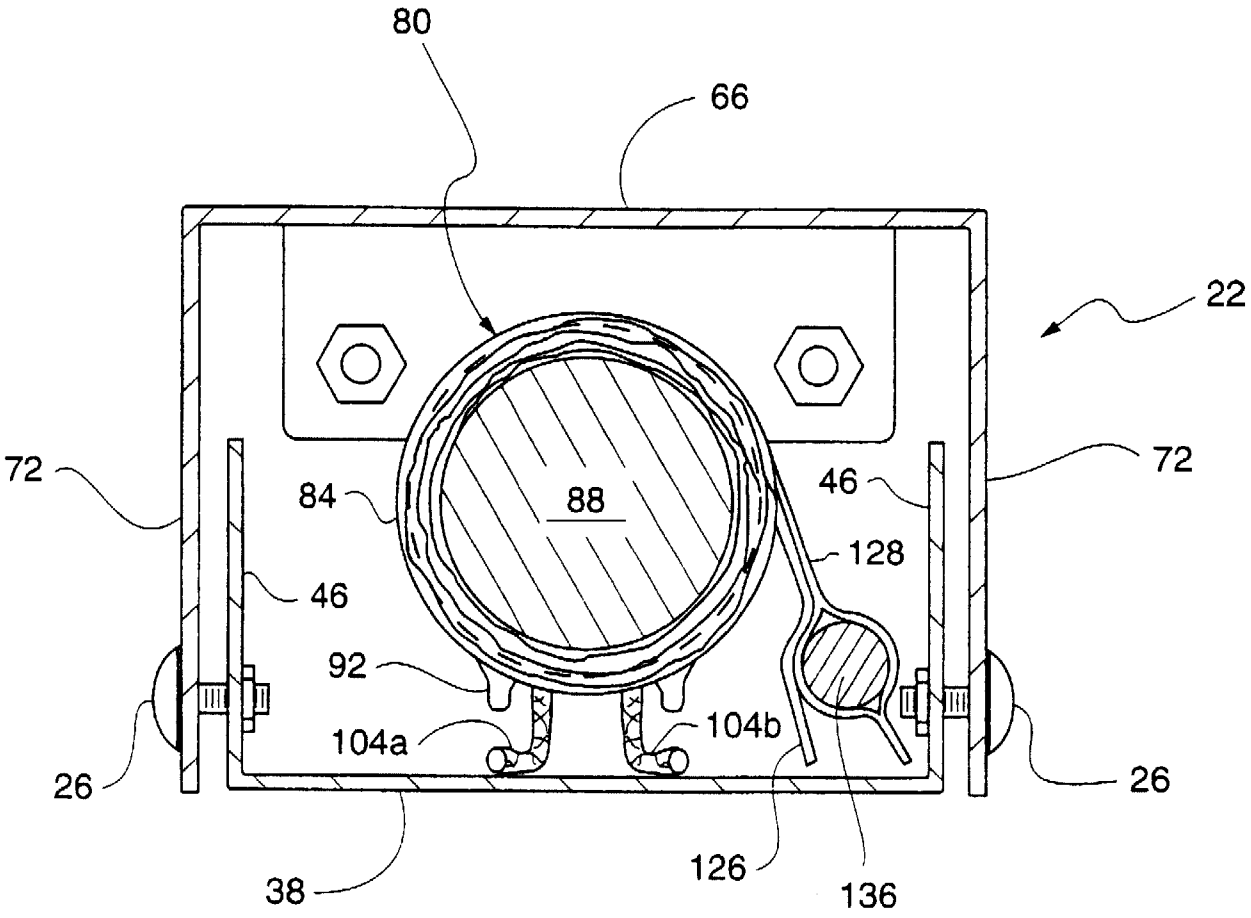
FIG. 9 presents is a lateral cross-section (taken through the cross section designated by arrows 9 in FIG. 1) showing the upper assembly 22 and the wall connector assembly 14 when they are pivoted or joined together in the overlapping relationship of FIG. 1.

Referring now to the upper support assembly 22, this assembly includes an exterior housing 62 having a top plate 66 integrally connected to two side arms 72 (as shown in FIGS. 2 and 9). Mounted within the interior of the upper support assembly 22 is a cover assembly 80, substantially cylindrical in shape and traversing the length of the upper support assembly interior between the free end 34 and the opposite end 36 where pivot 26 is attached. In particular, the cover support assembly 80 includes a flexible water barrier 84 (FIGS. 3 and 4), which in a raised or retracted configuration is substantially wrapped about an inner cylindrical barrel 88 (FIG. 9) of the cover assembly 80, the barrel providing the support for the flexible water barrier which is attached to the barrel 88 along its length. Note that the barrel 88 includes, in one embodiment, end caps 92 (FIGS. 7 and 9) at each end of the barrel and substantially adjacent to the ends 34 and 36 of the upper support assembly 22. Note that the end caps 92 are configured to cooperate with barrel fixing flanges 94 having mating protrusions and/or recesses (not shown) that are accessible for mating with counterparts of the end caps 92. Also, the end caps 92 and the barrel flanges 94 mate in a manner that allows the barrel 88 (and correspondingly the flexible water barrier 84) to rotate about a central longitudinal axis of the barrel extending substantially the length of the upper support assembly 22. Accordingly, as the barrel 88 rotates in the direction of arrow 96 (FIG. 7), the flexible water barrier 84 lowers or extends away from the barrel 88 as illustrated in FIG. 3. Alternatively, when the barrel 88 is rotated in the direction 100, the flexible water barrier 84 raises and is wrapped about the barrel.

Also included in the upper support assembly 22 and in operational cooperation with the barrel 88 and the end caps 92, is a water barrier regulating cord 104 (e.g., FIG. 2) which has cord segments labelled 104*a* and 104*b* (e.g., FIG. 7), wherein the cord cooperates with at least one of the end caps 92 and the barrel 88 for raising and lowering the water barrier 84 according to manual manipulation of the cord by a user of the present invention. Accordingly, in the embodiment of the figures, the cord 104 is attached to the end cap 92 adjacent to the shower wall 42 so that when cord segment 104*a* is urged by the user in the direction of arrow 108, the flexible water barrier 84 is lowered away from the upper support assembly 22, and when the cord segment 104*b* is pulled by the user in the direction of arrow 112, then the flexible water barrier is retracted or raised into the upper support assembly.

Figure 4:
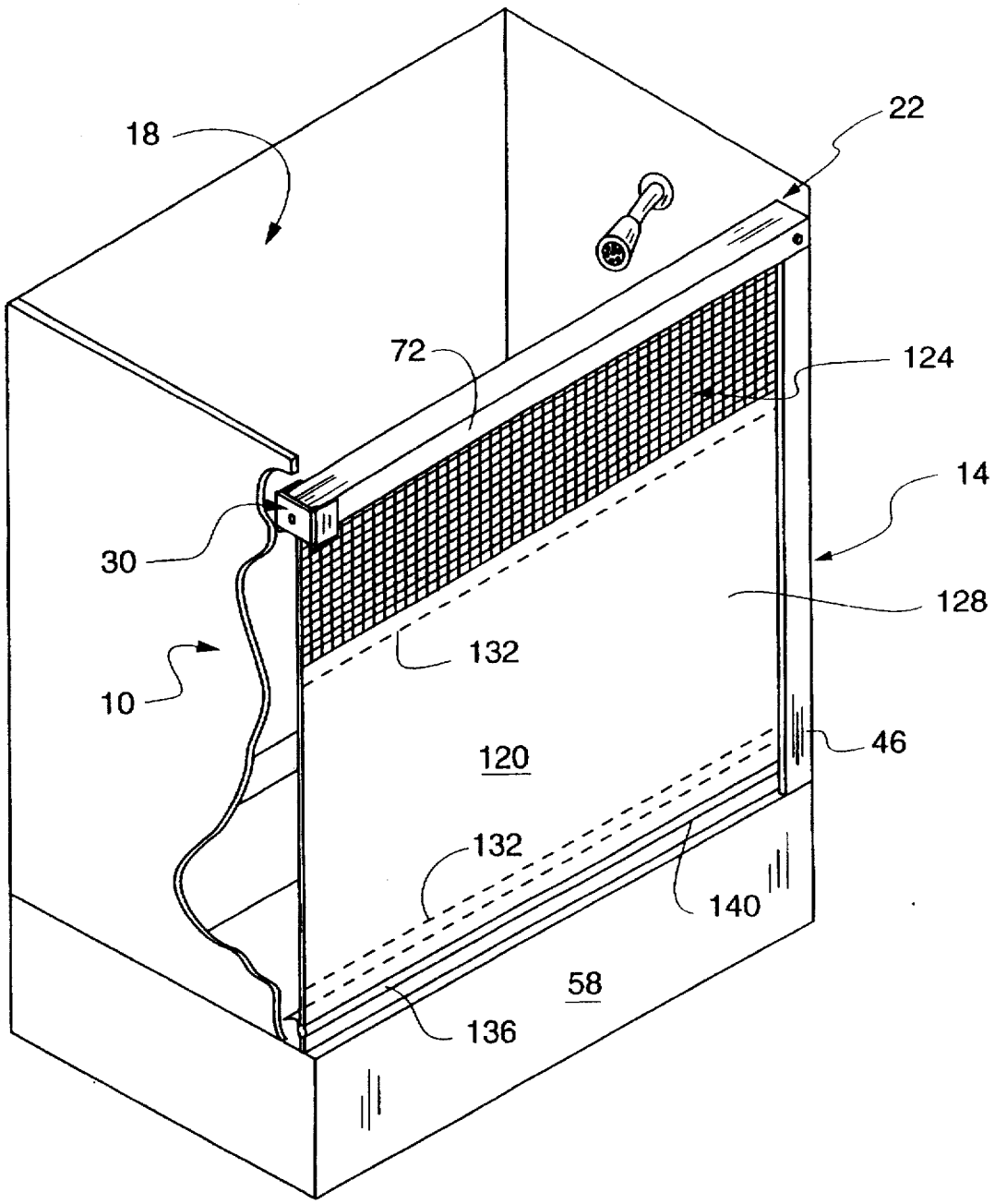
FIG. 4 is a perspective view of water barrier 84 fully extended from the upper support assembly 22 as when a user is taking a shower.

Referring now in more detail to the flexible water barrier 84 (e.g., FIG. 4), in one embodiment, this water barrier includes a bottom section 120 and a top section 124, both of these sections being attached to one another to form an effective water barrier when in a fully lowered position such as in FIG. 4. Note that the top section 124 may be of a flexible material that is mesh-like in that it allows relatively free flow of air therethrough while restricting the passage of shower spray therethrough. The bottom section 120 includes a flexible backing material 128 either attached to or contiguous with the material of the top section 124. The flexible backing material 128 extends the vertical length of the bottom section 120 (as positioned as in FIG. 4). Additionally, the bottom section 120 includes a removable layer of material 126 (shown retracted within the upper assembly in FIG. 9) attached to the backing material 128 on the shower enclosure 18 side, wherein this removable material serves as a removable shower curtain for retaining shower spray within the shower enclosure. In one embodiment of the present invention, the shower curtain layer of the bottom section 120 is attached to the flexible backing material 128 by Velcro fastener strips 132 (e.g. FIG. 4). Thus, the removable shower curtain layer can be easily removed and cleaned or replaced without disassembling the present invention.

The free end of the bottom section 120 also includes a curtain rod 136 traversing the horizontal width of the bottom section 120. In particular (as shown in FIG. 9), the curtain rod 136 is provided within a sleeve 140 of the backing material 128, the sleeve 140 traversing the width of the lower section 120 (FIG. 4). It is important to note that the vertical edge of the flexible water barrier 84 nearest the connector assembly 14 projects toward the shower enclosure wall 42 and between the legs 46 sufficiently so that not only is water inhibited from running out of the shower base 58, but also the water barrier 84 is maintained in an appropriate lowered position by the legs 46 restricting movement of the flexible water barrier, and in particular, the movement of the curtain rod 36 in a horizontal direction which might allow water to seep out of the shower enclosure 18. That is, by using the legs 46 to restrict movement of the curtain rod 36, this assists in preventing the water barrier 84 from flapping or moving away from the shower base 58 and thereby inhibits shower water from exiting the shower enclosure 18.

Figure 8:
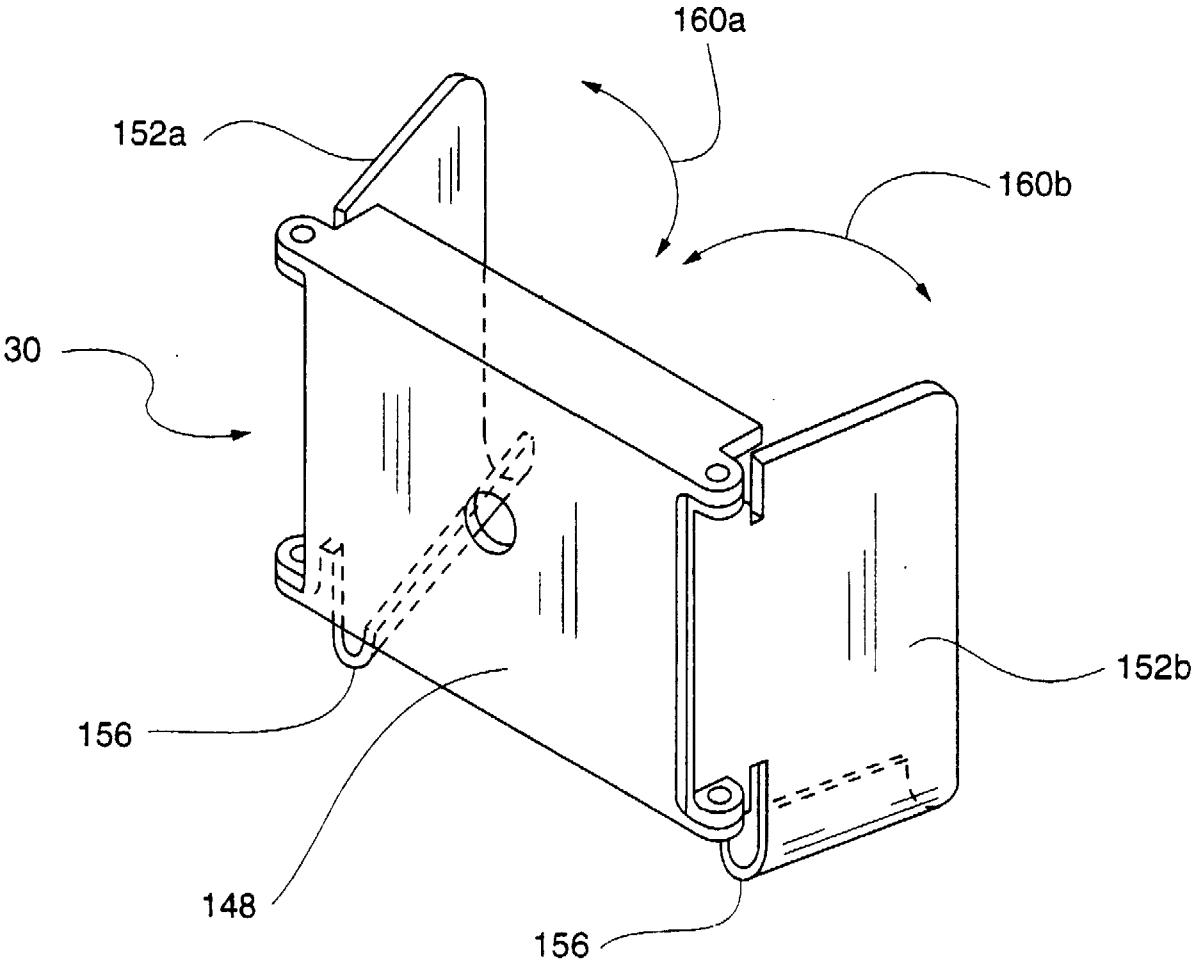
FIG. 8 is an enlarged perspective view of the receiver member 30 showing the wings 156 in an open position.

Referring now to the receiver member 30, reference is particularly made to FIG. 8. The receiving member 30 includes a connection plate 148 for connecting the receiver member to, for example, the shower enclosure wall opposite the wall 42 by a screw(s) and/or double faced tape. Attached to each vertical end of the connection plate 148 are hinged plates or wings 152. Note that each of the wings 152 is a mirror image of the other, and each of the wings has a curved lip 156 along its bottom horizontal extent wherein these lips are utilized in supporting the upper support assembly 22 when this assembly is in its extended configuration as will be described in further detail hereinbelow. The hinged wings 152 rotate about their hinges according to the directional arrows 160. That is, hinged wing **152*a* rotates about its hinge according to the directional arrow 160*a*, and hinged wing 152*b* rotates about its hinge according to directional arrow 160*b*. Thus, when the receiver member 30 is not being used to support the free end 34 of the upper support assembly 22, each of the wings 152 may be folded inwardly into a closed position wherein the wings are substantially parallel and adjacent to the connection plate 148. Alternatively, the wings 152 may be provided in an open position wherein the lips 156 project outwardly away from the connection plate 148 and in this position can be used to support the free end 134 of the upper support assembly 22**.

Figure 5:
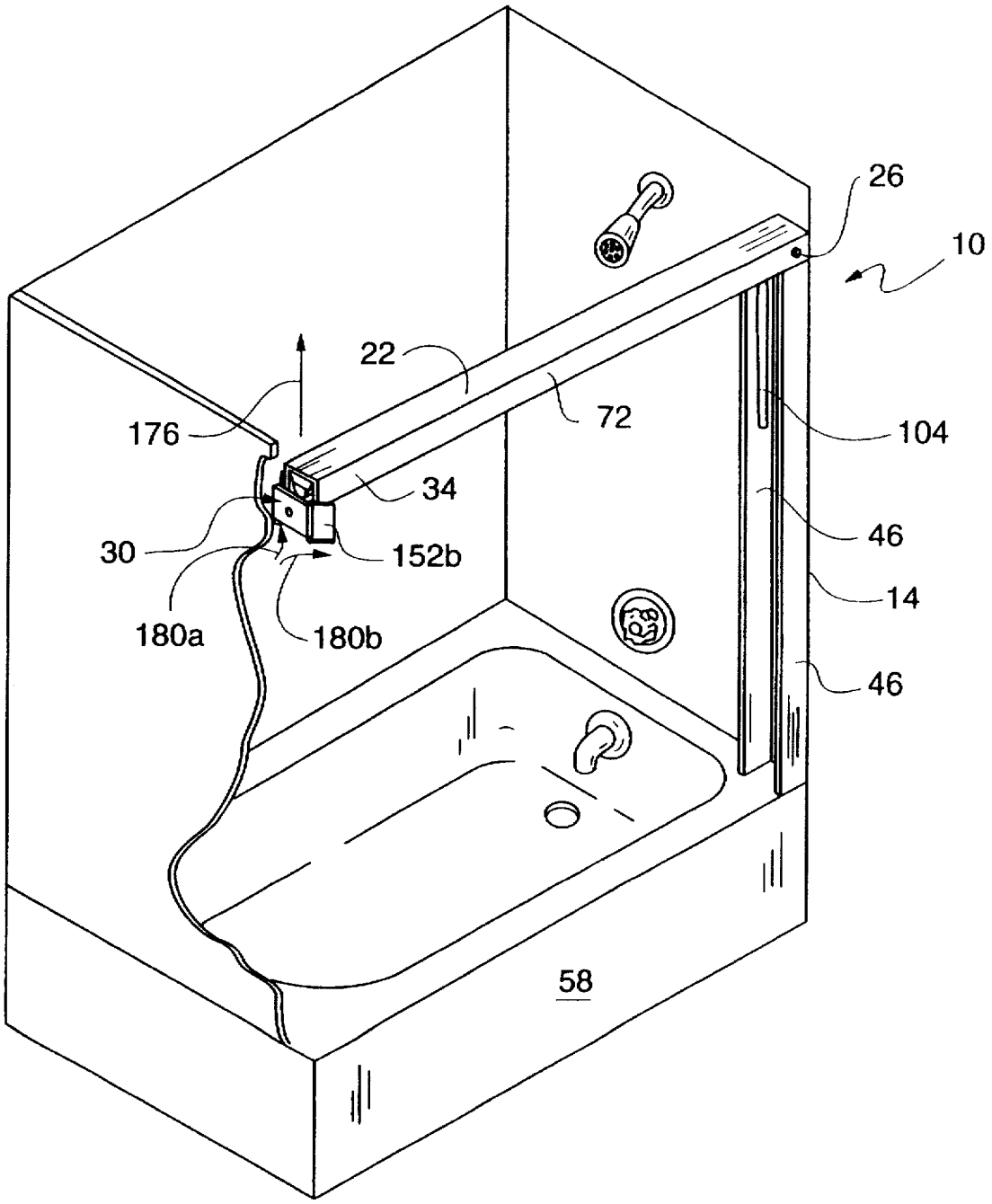
FIG. 5 is a perspective view of the upper support assembly 22 being pivoted slightly upward to permit mounting bracket wings 156 to be opened slightly in order to permit the upper support assembly 22 to pivot downward past the spread apart wings.
Figure 6:
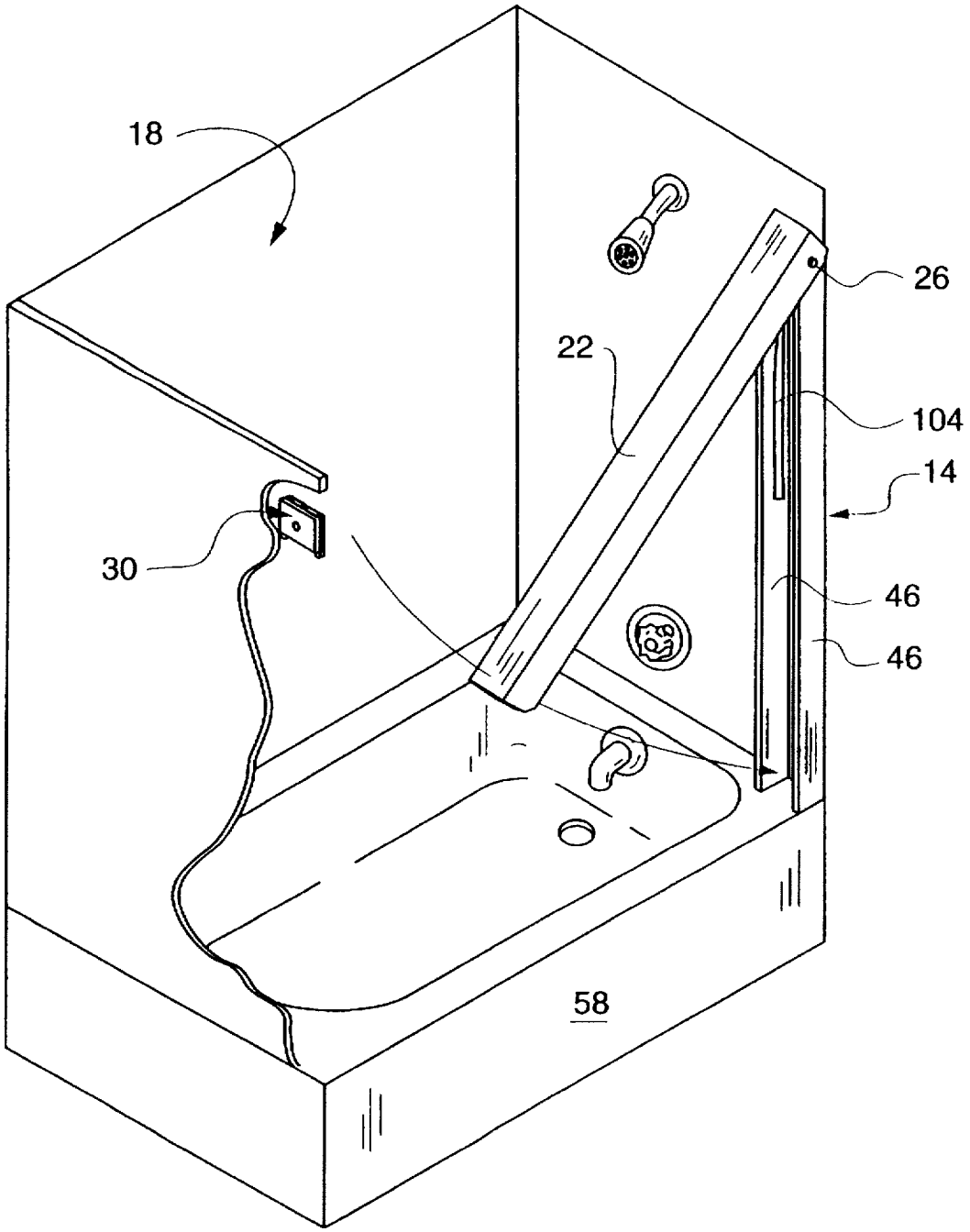
FIG. 6 is a perspective view showing the upper support assembly 22 pivoted halfway downward back towards the wall connector assembly 14.

In operation, once the wall connector assembly 14 and the receiver member 30 are attached to the shower enclosure 18 as in FIG. 1, FIGS. 2 through 6 illustrate the operation of the present invention in successive steps. Accordingly, FIG. 2 illustrates the extending of the upper support assembly 22 pivotally away from the wall connector 14 according to the arrow 168. In particular, since the exterior housing 62 surrounds the wall connector assembly 14 in the retracted position, it is relatively straightforward for a user to pivot the upper support assembly 22 as shown in FIG. 2. Subsequently, once the user rotates the first and second wings **152*a* and 152*b* into their open positions as also shown in FIG. 2, the support assembly 22 may be rotated until the arms 72 of the free end 34 rest in the curved lips 156 of the wings 152. Accordingly, with the upper support assembly 22 supported at its ends as in FIG. 3, a user may lower the flexible water barrier 84 by pulling downwardly on the cord segment 104*a* thereby causing the flexible water barrier to unwrap from the barrel 88. Subsequently, FIG. 4 is obtained when the flexible water barrier 84 is fully downwardly extended and thereby able to inhibit water from escaping the shower base 58 during a shower. Following the termination of the shower, a user may raise the water barrier 84 by pulling on the cord segment 104*b* and thereby causing the water barrier 84 to retract within the upper support assembly 22 and wrap around the barrel 88. Once the water barrier 84 is fully retracted into the upper support assembly 22, the upper support assembly may be disconnected from the receiver member 30 and pivotally retracted so that it becomes adjacent to and covering the wall connector assembly 14. FIG. 5 illustrates the direction of movement to be applied by the user to the upper support assembly 22 in disconnecting this assembly from the curved lips on the wings 152. That is, the free end 34 of the upper support assembly is moved by the user upwardly in the direction of arrow 176 a sufficient amount to disengage the arms 72 from the curved lips 56. Subsequently, the user rotates the wings 152 outwardly away from the connection plate 148 as illustrated by the arrows 180*a* and 180*b*. In particular, wing 152*a* is rotated in the direction of arrow 180*a* and wing 152*b* is rotated in the direction of arrow 180*b*. Thus, with the wings and their corresponding lips extended away from the upper support assembly arms 72, the upper support assembly may be rotated downwardly toward the wall connector assembly 14 as shown in FIG. 6**.

The foregoing discussion of the invention has been presented for purposes of illustration and description. Further, the description is not intended to limit the invention to the form disclosed herein. Consequently, variations and modifications commensurate with the above teachings, within the skill and knowledge in the relevant art, are within the scope of the present invention. The embodiment described herein above is further intended to explain the best mode presently known of practicing the invention and to enable others skilled in the art to utilize the invention as such or in other embodiments, and with various modifications required by their particular application or uses of the invention. It is intended that the appended claims be construed to include alternative embodiments to the extent permitted by the prior art.

What is claimed is:

1. A vertically movable shower curtain apparatus, comprising:

a wall connector assembly for connection to a first wall adjacent to a shower system, said wall connector assembly having a length that extends in a vertical direction;

an upper support assembly having a length and including a free end and an attachment end at opposite ends of said length, said support assembly being pivotally connected to said wall connector at said attachment end, said upper support assembly including an exposed side;

a cover assembly movable relative to said upper support assembly between a first raised position and second lowered position by engagement of said cover assembly through said exposed side of said upper support assembly, said cover assembly extending in said vertical direction when in said second lowered position, and said cover assembly having a width; and a receiver member for connection to a second wall for receiving said free end of said upper support assembly, said receiver member being spaced from said attachment end by a distance, and said upper support assembly length being substantially equal to said distance;

wherein said upper support assembly is pivotal between a first position and a second position, said upper support assembly length extending in a vertical linear direction along the first wall and said free end being adjacent to said wall connector in said first position and said free end being held by said receiver member in said second position, said wall connector assembly length being at least equal to said length of said upper support assembly, said wall connector assembly length being at least equal to said cover assembly width, said wall connector assembly covering said exposed side of said upper support assembly when said upper support assembly is in said first position wherein said cover assembly is surrounded along said width thereof using said wall connector assembly and said upper support assembly.

2. An apparatus, as claimed in claim 1, wherein:

said wall connector assembly includes a leg having a width of at least one-half inch extending from the first wall.

3. An apparatus, as claimed in claim 1, further including:

a curtain rod having an end and joined to a bottom section of said cover assembly and in which said end is held within said wall connector assembly.

4. An apparatus, as claimed in claim 1, wherein:

said wall connector assembly includes a leg and said upper support assembly includes an arm in which one of said leg and said arm overlaps the other of said leg and said arm when said wall connector assembly and said upper support assembly are pivotally joined together.

5. An apparatus, as claimed in claim 1, wherein:

said cover assembly includes a mesh member and a shower curtain with said mesh member being located vertically above said shower curtain when said cover assembly is in said second lowered position and in which said shower curtain is removably attached to said mesh member.

6. An apparatus, as claimed in claim 1, wherein:

said receiver member includes a connection plate and at least a first wing pivotal between an open position and a closed position and in which said upper support assembly is held by said receiver member when said first wing is in said open position.

7. An apparatus, as claimed in claim 1, wherein:

said wall connector assembly includes a pair of legs that extend outwardly from the first wall and in which free end portions of said cover assembly are disposed between said two legs when said cover assembly is in said second lowered position.

* * * * *